US007584543B1

(12) United States Patent
Boyd

(10) Patent No.: US 7,584,543 B1
(45) Date of Patent: Sep. 8, 2009

(54) ARCHERY BOW SIGHT

(76) Inventor: Alvin L. Boyd, 10170 Jordan Rd., Argenta, IL (US) 62501

( * ) Notice: Subject to any disclaimer, the term of this patent is extended or adjusted under 35 U.S.C. 154(b) by 0 days.

(21) Appl. No.: 12/291,327

(22) Filed: Nov. 7, 2008

Related U.S. Application Data

(60) Provisional application No. 61/003,175, filed on Nov. 15, 2007.

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | | |
|---|---|---|---|---|---|
| 2,545,454 | A * | 3/1951 | Fredrickson | 33/265 |
| 3,674,002 | A * | 7/1972 | Diamond, Sr. | 124/87 |
| 4,417,403 | A * | 11/1983 | Strange | 33/265 |
| 4,497,116 | A * | 2/1985 | Hawkins | 33/265 |
| 4,625,420 | A * | 12/1986 | Figured | 33/265 |
| 4,915,088 | A * | 4/1990 | Powers | 124/87 |
| 4,967,478 | A * | 11/1990 | Sherman | 33/265 |
| 5,048,193 | A * | 9/1991 | Hacquet | 33/265 |
| 5,651,185 | A * | 7/1997 | Vanderheyden et al. | 33/265 |
| 5,718,215 | A * | 2/1998 | Kenny et al. | 124/87 |
| 5,802,726 | A * | 9/1998 | Trosper et al. | 33/265 |
| 5,864,958 | A * | 2/1999 | Giddens | 33/265 |
| 5,920,996 | A * | 7/1999 | Hurckman et al. | 33/265 |
| 6,098,608 | A * | 8/2000 | Oshlick | 124/87 |
| 6,493,951 | B1 * | 12/2002 | Smith et al. | 33/265 |
| 6,796,037 | B1 * | 9/2004 | Geffers et al. | 33/265 |
| 6,796,039 | B2 * | 9/2004 | Walbrink | 33/265 |
| 6,868,614 | B2 * | 3/2005 | Floied et al. | 33/265 |
| 2004/0107587 | A1 * | 6/2004 | Floied et al. | 33/265 |

* cited by examiner

*Primary Examiner*—Christopher W Fulton
(74) *Attorney, Agent, or Firm*—Philip L. Bateman

(57) ABSTRACT

An archery bow sight has a rear sight and a front sight that remain in a line of sight from the archer's sight eye to targets of varying distance. The sight includes (a) a frame adapted for mounting onto a bow; (b) a rear sight attached to the frame, the rear sight being movable vertically and being positioned a first horizontal distance from the archer's sight eye; (c) a front sight attached to the frame, the front sight being movable vertically, being positioned a second horizontal distance from the archer's sight eye, and being further positioned in a line of sight from the archer's sight eye through the rear sight; (d) a linkage between the rear sight and the front sight for simultaneously moving the rear sight a first vertical distance and the front sight a second vertical distance to correspond to targets of varying distance; and (e) a means for initially adjusting the sight to conform to a draw length of a particular archer to ensure that the ratio of the first vertical distance divided the second vertical distance equals the first horizontal distance divided by the second horizontal distance.

17 Claims, 15 Drawing Sheets

$$\overline{BD} / \overline{CE} = \overline{AB} / \overline{AC} = \overline{AD} / \overline{AE}$$

LET $X = \overline{AB} = \overline{VW} = \overline{PQ}$
LET $C = \overline{WZ}$
$X/D = C/G \Longrightarrow C = G\,(X/D)$
$S = \text{arc tan}(C/X) = \text{arc tan}(G/D)$

| YD range | pin elevation | arrow velocity | arrow fall | range scale |
|---|---|---|---|---|
| 9.8 | 2.91 | 218 | 4 | 0 |
| 10 | 2.91 | 218 | 4 | 0 |
| 20 | 2.74 | 215 | 15 | 0.49 |
| 30 | 2.48 | 213 | 33 | 1.29 |
| 40 | 2.18 | 211 | 60 | 2.19 |
| 50 | 1.86 | 208 | 95 | 3.13 |
| 60 | 1.54 | 206 | 138 | 4.11 |
| 70 | 1.2 | 204 | 190 | 5.12 |
| 80 | 0.85 | 202 | 251 | 6.16 |
| 90 | 0.5 | 199 | 321 | 7.23 |
| 100 | 0.13 | 197 | 401 | 8.32 |
| 110 | -0.24 | 195 | 490 | 9.44 |
| 120 | -0.62 | 193 | 590 | 10.58 |

Input Data eye elevation above arrow 3.5
eye distance to front sight 30

Arrow initial velocity 220
Arrow mass 400 mechanical advantage 3.0

ARCHERY BOW SIGHT

CROSS-REFERENCE TO RELATED APPLICATION

This application claims the benefit of U.S. Provisional Application Ser. No. 61/003,175, Nov. 15, 2007.

FIELD OF THE INVENTION

This invention relates to the sport of archery. More particularly, this invention relates to archery bow sights.

BACKGROUND OF THE INVENTION

1. Archery Bow Sights in General

Archery is a popular sport in hunting and target shooting. With the advent of the compound bow, the sport has grown and the development of effective sights has accelerated. Most archers now have a sight on their bow. The sight is generally mounted on the bow just above the handle and arrow rest as shown in FIG. 1. A right-handed archer holds the bow in a vertical position with his left hand and pulls the bowstring back with his right hand to a point on his right cheek, known as the anchor point. He then positions the bow so the target is lined up with the sight point and his right eye. The right eye is sometimes referred to as the sight eye for a right-handed archer. The distance between the bowstring and the handle of the bow at full draw (pulled to the anchor point) is known as the draw length. The draw length varies depending on the physical dimensions (especially the arm length) of the archer.

Due to the downward trajectory of the arrow, one point on a sight is accurate for only one distance. To cover targets of multiple distances, several sight points are vertically spaced and are individually set by the archer so each sight point corresponds to a predetermined target distance. Alternatively, a single sight point is used which is vertically movable to predetermined positions corresponding to predetermined target distances.

2. Sights Having Front and Rear Sights

To aim at a target, two points must be lined up with the target. If an archer could always have exactly the same anchor point, then the archer's eye and one sight point for each distance could be very accurate. However, to always get exactly the same anchor point is difficult without an aid. A common solution is to mount a "peep" on the bowstring. A peep is generally a small disc with a smaller hole in the center of it. The strands of the bowstring are separated and the peep is inserted between the strands. The archer then looks through the peep at the front sight point. The center of the peep functions as a second, rear sighting point that is used with the front sight point to provide two points to align with the target.

FIG. 2 represents the lines of sight with the use of a peep. The rear loop (the one closest to the sight eye) represents the peep and the front loops represent multiple front sight points. The eye is so close to string mounted peep that the lines of sight diverge very little. Thus very little change in anchor point is required to align the eye with the lines of sight. But the use of a string mounted peep has several problems, among these are: the peep restricts light to the archer's eye and in the best hunting times of dawn and dusk this may be a problem, the string may rotate so that the peep hole is incorrectly aligned, and also, a peep may be difficult to use with glasses, particularly with bifocals. The need for an alternative to the string mounted peep has produced a progression of options.

3. Sights with a Single Fixed Front or Rear Sight Point

A common option for eliminating the string mounted peep is to mount a stationary, rear sight point on an arm attached to the bow above the handle and extending back, but still in front of all cables and strings. This stationary rear sight point can be used as the second point to line up with the multiple front sight points which are in front of the handle. The lines of sight for this type of sight are represented in FIG. 3A. For the best accuracy, it is important to always use the same anchor point. However, the archer's eye is not close to this second sight point, so his anchor point must change to align his eye with each line of sight to each of the multiple front sight points. Also, for distances between the predetermined distances, the archer must estimate a front sight point between the fixed front sight points. There is also the chance of confusion in point selection with multiple sight points. This sight configuration is disclosed in Powers, U.S. Pat. No. 4,915,088, Apr. 10, 1990; Hacquet, U.S. Pat. No. 5,048,193, Sep. 17, 1991; Giddens, U.S. Pat. No. 5,864,958, Feb. 2, 1999; and Oshlick, U.S. Pat. No. 6,098,608, Aug. 8, 2000.

A second proposal is to use multiple vertically positioned rear sighting points and a single front sighting point. The lines of sight for this type of sight are represented in FIG. 3B. Archery sights of this type are disclosed in Figured, U.S. Pat. No. 4,625,420, Dec. 2, 1986, and Sherman, U.S. Pat. No. 4,967,478, Nov. 6, 1990. This type of sight has the same disadvantage as the previous type, namely, the change required in the anchor point for each target distance and the possibility of confusion in point selection with multiple sight points.

Walbrink, U.S. Pat. No. 6,796,039, Sep. 28, 2004, discloses a bow sight with a movable front pin and a single fixed rear sight point. It is adjustable at full draw with a lever. FIG. 3C illustrates the lines of sight for of this sight with alternate positions of the front sight shown in broken lines. The multiple sight point problem is eliminated, but a change in anchor point is required for each change in target range.

Strange, U.S. Pat. No. 4,417,403, Nov. 29, 1983, discloses a bow sight with a movable rear sight point and a single front sight point. It is not adjustable at full draw. FIG. 3D illustrates lines of sight for this sight where alternate positions of the rear sight point are shown in broken lines. The sight eliminates the multiple sight point problem but requires an anchor point change for each target range.

4. Sights with Multiple Front and Rear Sight Points

Another type of archery bow sight has multiple front sight points and rear sight points, with each front sight point paired with a particular rear sight point and with each pair corresponding to a predetermined distance. A sight of this type is disclosed in Trosper, U.S. Pat. No. 5,802,726, Sep. 8, 1998. The lines of sight for this type of sight is represented in FIG. 4A. When accurately adjusted for an individual, this sight eliminates the need for anchor point adjustments. However, this sight would be difficult to calibrate since all of the sight points would require individual adjusts. Also, the confusion of sight points selection is compounded with the possible incorrectly pairing of sight points.

It is generally accepted that replacing multiple sight points with a movable sight point improves accuracy. Many competitive archers use a string mounted peep and a single movable front sight point, but for hunting movable sight points also need to be adjustable at full draw for quick adjustment with a sudden change in target range. Several patents with a rear and front sight point have employed movable sight points. Vanderheyden, U.S. Pat. No. 5,651,185, Jul. 29, 1997, discloses a bow sight with a movable rear sight point and multiple front sight points for predetermined target ranges. It is adjustable at full draw with a lever. FIG. 4B illustrates the lines of sight for this sight with alternate rear sight point positions shown in broken lines and with three front sight points. This sight eliminates the need for anchor point adjustments, but the confusion of selecting from multiple sight points remains. This sight would require the archer to select the correct position for the movable rear sight point and also to select the correct front sight point. This selection would be compounded for target ranges between the predetermined ranges. The initial calibration of this sight would require the setting of all the front sight points and the identification of all the positions of the rear movable point.

5. Sights with Movable Front and Movable Rear Sight Points

A single movable front sight point and a single movable rear sight point eliminates the confusion of sight point selection. This type of sight is disclosed in Hawkins, U.S. Pat. No. 4,497,116, Feb. 5, 1985; Hurckman, U.S. Pat. No. 5,920,996, Jul. 13, 1999; and Geffers U.S. Pat. No. 6,796,037, Sep. 28, 2004. Hawkins and Hurckman disclose sights adjustable at full draw with a lever. The Geffers sight is not adjustable at full draw. The lines of sight for this type of sight is represented in FIG. 4C where alternate positions of both the front and rear sight points are shown in broken lines. As shown, the archer's sight eye is located too far away from the sight for the lines of sight to converge exactly. The ideal is achieved only if the sight points move so that all lines of sight for different target ranges intersect at one point and if the archer's eye is at that point of intersection. Depending on the archer's draw length, the distance of his eye from the sight points is going to change. Hawkins, Hurckman, and Geffers disclose various mechanisms for moving the sights. Other mechanisms for moving sights are also known. For example, Smith et al., U.S. Pat. No. 6,493,951, Dec. 17, 2002, discloses a belt drive for moving a sight point.

Accordingly, none of these patents present a solution for this problem of different draw lengths for different archers. The geometry of the Geffers patent would allow all lines of sight converging at one point and for some archers with the right draw length, it will work. However on the Hawkins and Hurckman patents with the sight points moving along curved paths, the lines of sight will not converge to a single point. All these sights are complex with several parts.

6. Need for Improvement

From the number of attempts to design a sight to eliminate the string mounted peep, it is apparent that there is a desire and need for such an archery bow sight. The objective is a bow sight with a single movable front sight point and a single movable rear sight point that enables and requires the archer to precisely reach the same anchor point every time, that is adjustable at full draw, and that is easily and precisely calibrated to fit any archer's draw length.

More particularly, there is a need for an improved archery bow sight that: (a) has a single movable front point and a single movable rear sight point that will exactly align the two sight points with the archer's eye for every target range with no change in the anchor point; (b) can be easily adjusted for any archer's draw length with any bow; (c) has movable sight points that can be easily adjusted for target range while at full draw; (d) has a range adjustment means that operates quickly, smoothly, accurately, and quietly; (e) has an elongated range scale to increase resolution for improved accuracy; (f) has an individualized computer generated range scale such that after the sight is aimed in for one distance, the sight is correct for all distances; and (g) can be assembled to be used either right or left handed.

SUMMARY OF INVENTION

The general object of this invention is to provide an improved archery bow sight.

I have invented an archery bow sight for use by an archer holding a bow with a first hand, fully drawing an arrow mounted in the bow to an anchor point with a second hand, and aiming with a sight eye. The bow sight comprises: (a) a frame adapted for mounting onto a bow; (b) a rear sight attached to the frame, the rear sight being movable vertically and being positioned a first horizontal distance from the archer's sight eye; (c) a front sight attached to the frame, the front sight being movable vertically, being positioned a second horizontal distance from the archer's sight eye, and being further positioned in a line of sight from the archer's sight eye through the rear sight; (d) a linkage between the rear sight and the front sight for simultaneously moving the rear sight a first vertical distance and the front sight a second vertical distance to correspond to targets of varying distance; and (e) a means for initially adjusting the sight to conform to a draw length of a particular archer to ensure that the ratio of the first vertical distance divided the second vertical distance equals the first horizontal distance divided by the second horizontal distance, the means comprising either an adjustment to the linkage to adjust the ratio of the first vertical distance divided the second vertical distance or an adjustment to horizontal position of the rear sight or front sight to adjust the ratio of the first horizontal distance divided by the second horizontal distance; such that the rear sight and the front sight remain in a line of sight from the archer's sight eye to targets of varying distance.

The archery bow sight of this invention contains movable rear sight point and a movable front sight point that are aligned with the target to aim the bow. The sight points can be moved for target range while at full draw. The sight synchronizes the movement of the front and rear sight points such that the points always align with the archer's eye without any change in the archer's anchor point. With the correct individualized computer generated range scale, after the sight is aimed in for one range, the sight is then correct for all ranges.

DETAILED DESCRIPTION OF THE INVENTION

1. The Invention in General

Figure 2:
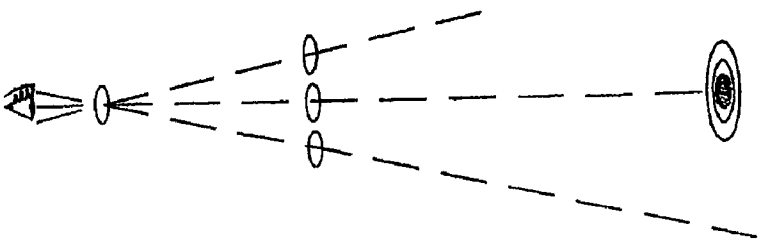
FIG. 2 (PRIOR ART)
FIG. 2 is a representation of a prior art archery bow sight.
Figure 1:
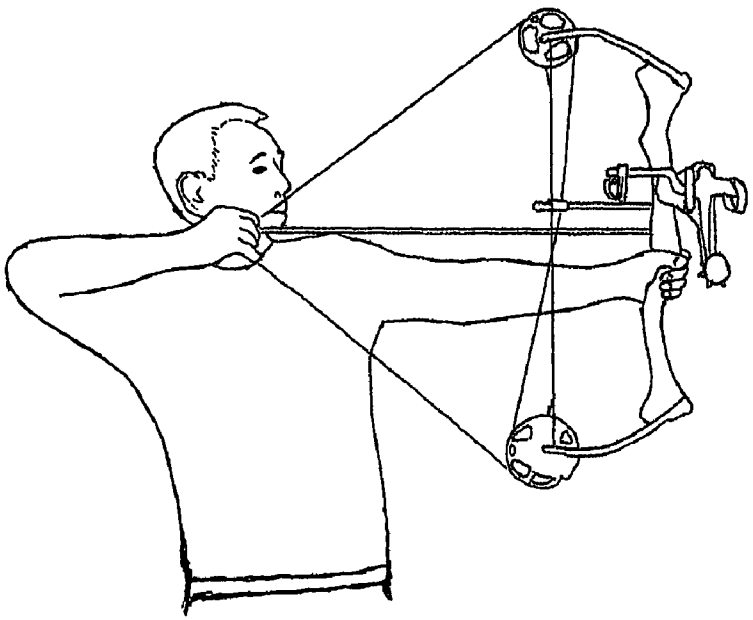
FIG. 1 (PRIOR ART)
FIG. 1 is a perspective view of an archer aiming a bow with an archery bow sight having front and rear sight points.
Figure 3A:
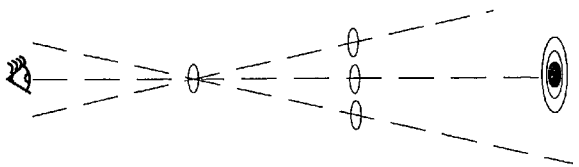
FIG. 3A (PRIOR ART)
FIG. 3A is a representation of a prior art archery bow sight.
Figure 3B:
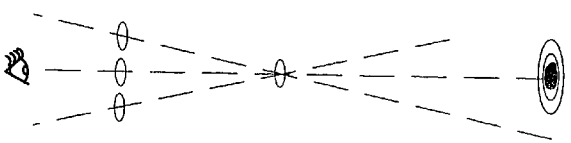
FIG. 3B (PRIOR ART)
FIG. 3B is a representation of a prior art archery bow sight.
Figure 3C:
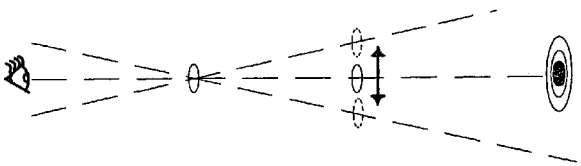
FIG. 3C (PRIOR ART)
FIG. 3C is a representation of a prior art archery bow sight.
Figure 3D:
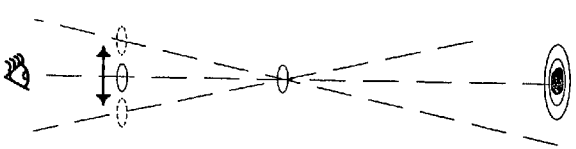
FIG. 3D (PRIOR ART)
FIG. 3D is a representation of a prior art archery bow sight.
Figure 4A:
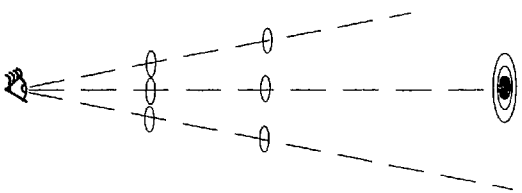
FIG. 4A (PRIOR ART)
FIG. 4A is a representation of a prior art archery bow sight.
Figure 4B:
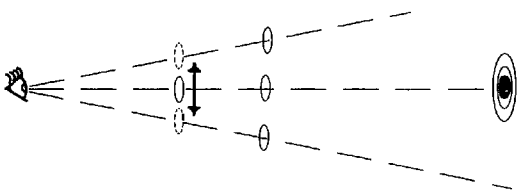
FIG. 4B (PRIOR ART)
FIG. 4B is a representation of a prior art archery bow sight.
Figure 4C:
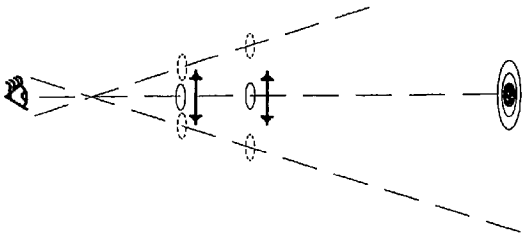
FIG. 4C (PRIOR ART)
FIG. 4C is a representation of a prior art archery bow sight.
Figure 5:
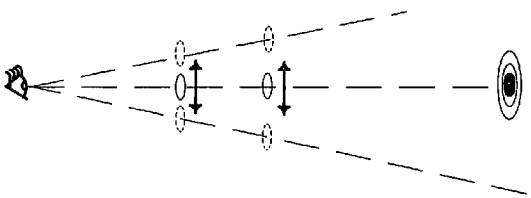
FIG. 5 is a representation of the archery bow sight of this invention.

The archery bow sight of this invention contains a rear sight and a front sight. The two sights are connected by a linkage that moves the rear sight a first vertical distance and the front sight a second vertical distance to correspond to targets of varying distance. An initial draw length adjustment is necessary because different archers have different draw lengths (the distance from the sight eye to a fixed point on the bow). Once this initial draw length adjustment is made, both sight points remain in a line of sight from the archer's sight eye to targets of varying distance. This relationship is shown in FIG. 5.

Figure 6:
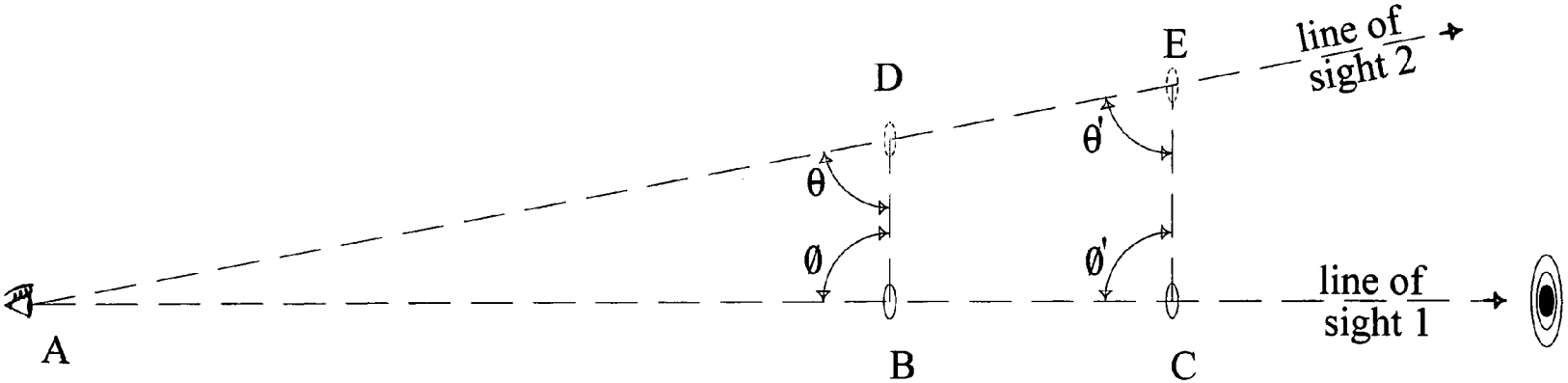
FIG. 6 is a representation of the lines of sight thereof.

The geometric relationship that ensures the two sight points remain in the line of sight regardless of target distance is as follows: the ratio of the first vertical distance divided the second vertical distance equals the ratio of the distance from the archer's sight eye to the rear sight point divided by the distance from the archer's sight eye to the front sight. This relationship is illustrated in FIG. 6 where one line of sight to a target is represented by line ABC and a second line of sight to a closer (but not shown) target is represented by line ADE. From simple geometry, it can be appreciated that the ratio of line BD divided by line EC is equal to the ratio of line AB divided by line AC. It is also equal to the ratio of line AD divided by line AE. This relationship can be represented by the formula $$BD/CE=AB/AC=AD/AE$$

where BD is the vertical distance moved by the rear sight from line 1 to line 2

CE is the vertical distance moved by the front sight from line 1 to line 2

AB is the distance from the sight eye to the rear sight at line 1

AC is the distance from the archer's sight eye to the front sight at line 1

AD is the distance from the sight eye to the rear sight at line 2

AE is the distance from the sight eye to the front sight at line 2

FIG. 6 also illustrates why an initial adjustment for the archer's draw length is necessary. The archer's draw length affects the ratio of AB/AC and AD/AE. The particular linkage between the front and rear sight affects the ratio of BD/CE. To maintain the equality of the ratios for archers having different draw lengths, two options are available. A first option is to adjust the linkage of the front and rear sights (thus changing BD/CE to conform to fixed AB/AC and AD/AE). This option is used in the preferred embodiment described below. A second option is to adjust the horizontal position of the rear sight (thus changing AB/AC to conform to the fixed BD/CE). This option is used in the alternate embodiments described below. A third option is to adjust the horizontal position of the front sight.

A more detailed explanation of the geometric relationship is as follows. Points C and E represent two settings for the front sight point and points B and D represent two settings for the rear sight point. The movement of the front sight point is restricted to a vertical path and likewise, the movement of the rear sight point is restricted a vertical path. Vertical lines are parallel. The angle at $\theta$ is formed by the intersection of the path of the rear sight point and the top line of sight. The angle at $\theta'$ is formed by the intersection of the path of the front sight point and the top line of sight. In fact, these two angles are equal, being corresponding angles when a third line intersects two parallel lines. Likewise, the two corresponding angles, $\phi$ and $\phi'$ are also equal. Therefore, we know that the triangle formed by the two lines of sight and the rear sight point path is similar to the triangle formed by the two lines of sight and the path of the front sight point because their corresponding angles are equal (the triangle formed by points A, B, and D is similar to triangle formed by points A, C and E).

In two similar triangles, the corresponding sides are proportional, thus the ratio of the distances the two sight points move is equal to the ratio of the distances of the sights from the archer's eye. Thus, for any archer, the ratio of the required movements of the rear sight point and the front sight point is equal to the ratio of the distances from the archer's eye to the rear sight point and the front sight point. Thus, if a sight is constructed that has front and rear sights that only move vertically and where they move in a constant ratio, then those points will constantly align if their distances from the archer's eye is in the same ratio.

2. Structure of the Preferred Embodiment

Figure 7A:
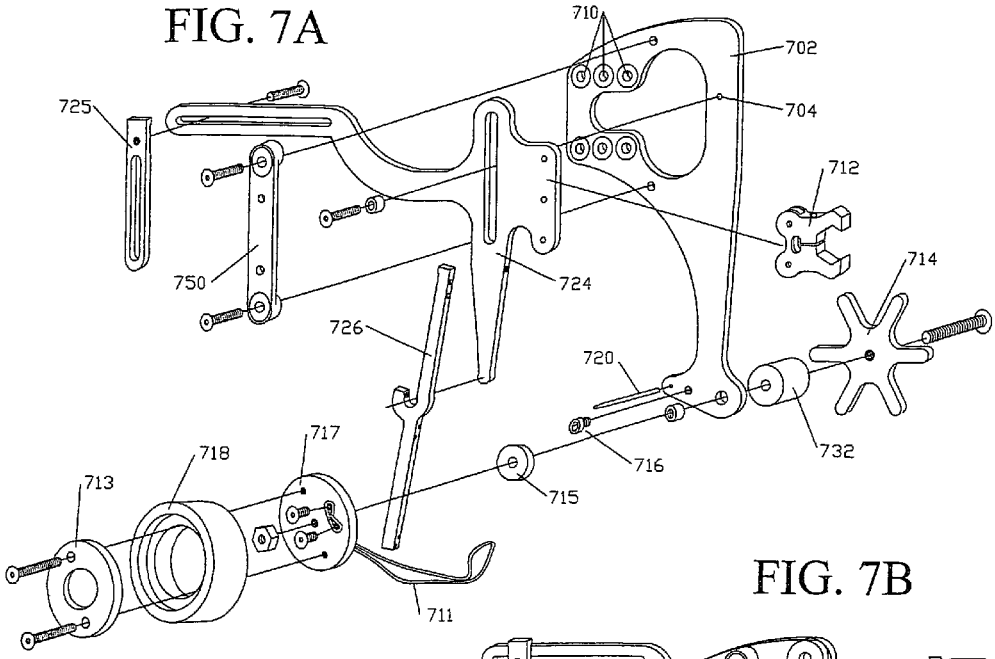
FIG. 7A is an exploded perspective view of a preferred embodiment thereof.
Figure 7B:
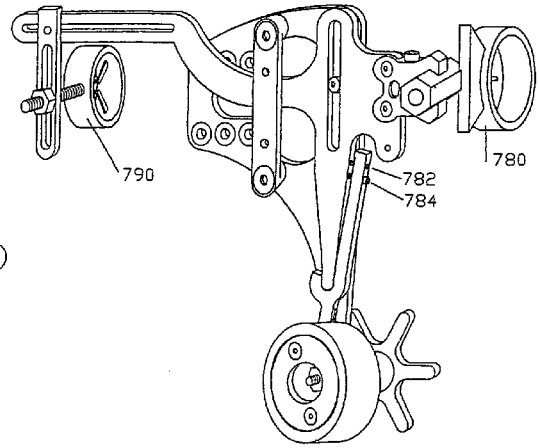
FIG. 7B is an assembled left side perspective view thereof.
Figure 7C:
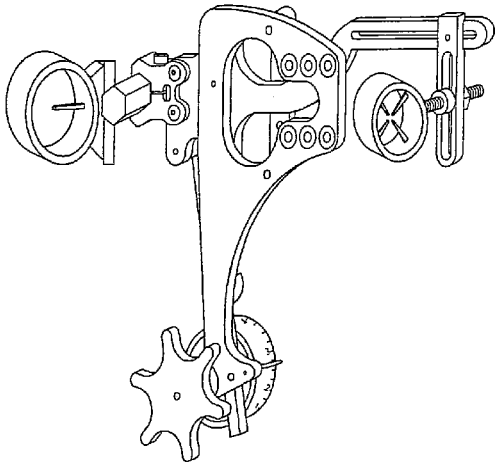
FIG. 7C is an assembled right side perspective view thereof.

The preferred embodiment of the archery bow sight is shown in FIGS. 7A to 7C. This embodiment is known as the "angle offset" embodiment. The sight base 702 is mounted to the bow just above the handle using two screws through one of the three pairs of holes 710. The base has two pivot posts to guide the movement of the sight carrier 724. The first pivot is a bushing secured to the base with a screw in hole 704. The vertical slot in the sight carrier slips onto the bushing and the bridge 750 is secured to the base with two screws so that the sight carrier can slide freely, sandwiched between the base and the bridge.

The strut 726 is mounted on the downward arm on the sight carrier and is secured with a cap screw 784 near the top end of the strut. A set screw 782 in the top hole of the strut is used in conjunction with the cap screw to adjust the angle of the strut. The second pivot to guide the sight carrier is the strut working against the windlass drum 715. The windlass drum is mounted on the screw that is installed through the finger dial 714, the spacer 732, the base and a bushing. This screw then goes through the windlass drum and the range hub 717 and is secured with a lock nut. The lower arm of the strut is restricted between the windlass drum and the head of cap screw 716.

Figure 7D:
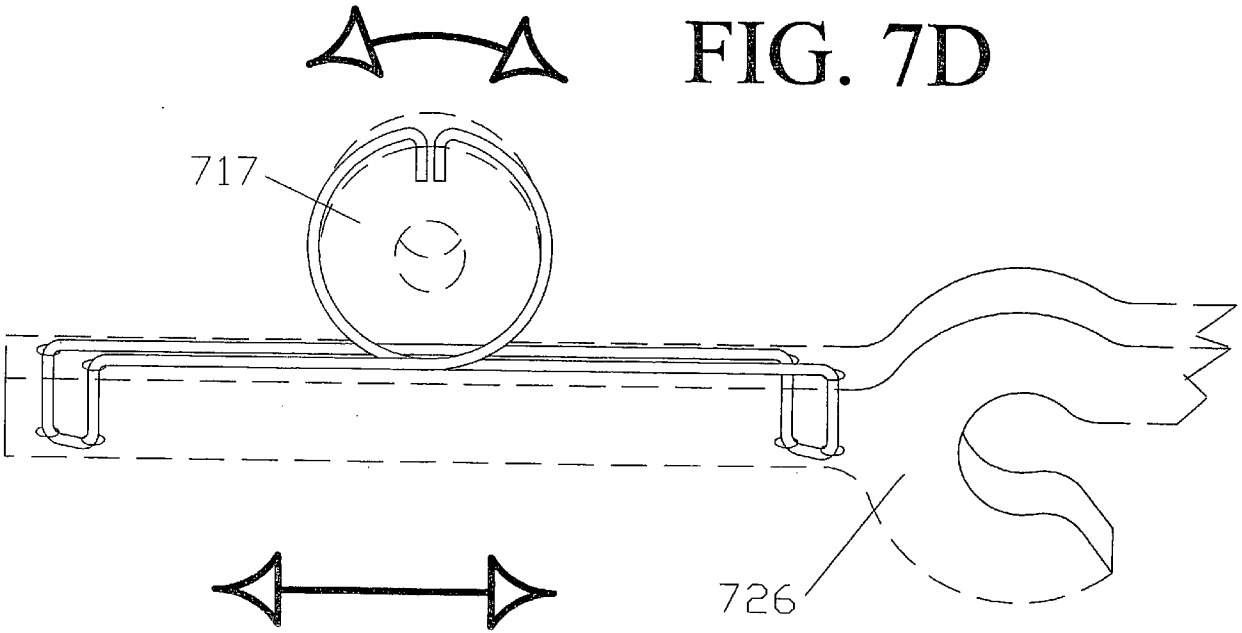
FIG. 7D is a detailed perspective view of the windlass cable thereof.

Cable 711 is inserted between the windlass drum and the strut and then the ends are threaded through holes in the top and bottom of the lower strut arm. Next each end is threaded back through the adjacent hole. Together the two ends make one wrap around the windlass drum, are threaded through the hole in the range hub, and then are secured with the two screws. The cable is shown in detail in FIG. 7D. Rotation of the finger dial now forces the strut and the sight carrier to slide along the two pivot points. Because the vertical slot and the strut arm are not parallel, the sight carrier rotates slightly with this movement. The resulting vertical movement of the rear of the carrier is less than the front of the carrier. The ratio of this movement can be changed by changing the angle between the vertical slot and the strut. This angle is changed by adjusting the two screws in the top of the strut.

Finally, the range drum 718 is clamped between the clamping hub 713 and the range hub. A computer generated range scale (shown in FIG. 7I and discussed in detail below) is wrapped around and attached to the range drum. A pointer 720 is mounted on the extension of the sight base behind the range drum. The rear sight bracket 725 is attached along the arm on the rear sight carrier and the jaws 712 is attached to the front of the sight carrier. A rear sight 790 is mounted in the vertical slot in the sight bracket. A front sight assembly 780 mounted on a hexagon shaft is clamped in the jaws on the front of the sight carrier.

The angle offset embodiment is preferred for several reasons. It is the simplest with the fewest parts and the easiest to assemble. The placement of the front and rear sight points is not critical, i.e., they can be placed any distance apart and can be extended any distance in front of the bow. The rear and front sights move vertically along an arc rather than along a straight line. The movement of the sights in an arc provides a significant advantage if the sight is used with a scope or a laser pointer. However, the distance moved is so small that it makes no discernible difference in many other respects.

3. Draw Length Adjustment

When the "angle offset" embodiment is mounted on a bow, the finger dial extends down close to the handle on the bow such that the dial can be rotated with the index finger. The strut angle on this sight can be set for draw lengths from 24 inches to 36 inches. To check the draw length setting of the sight, mount the front and rear sight points, and align them with the archer's eye at anchor point. Now, move the elevation of the sight points with the finger dial. As viewed from the anchor point, if the rear pin moves faster than the front point when moving either up or down, then the rear pin is moving too fast. To slow it down, the angle of the strut is increased by adjusting the two screws in the top of the strut. If the rear pin falls behind the front pin when moving either direction, then the rear pin is moving too slow. To speed up the rear pin, the angle of the strut is decreased by adjusting the two screws to pull the strut closer to the sight carrier. When the strut angle is correct for draw length, then the front sight point, the rear sight point, and the archer's eye align for every elevation, when they align for one elevation.

Figure 7E:
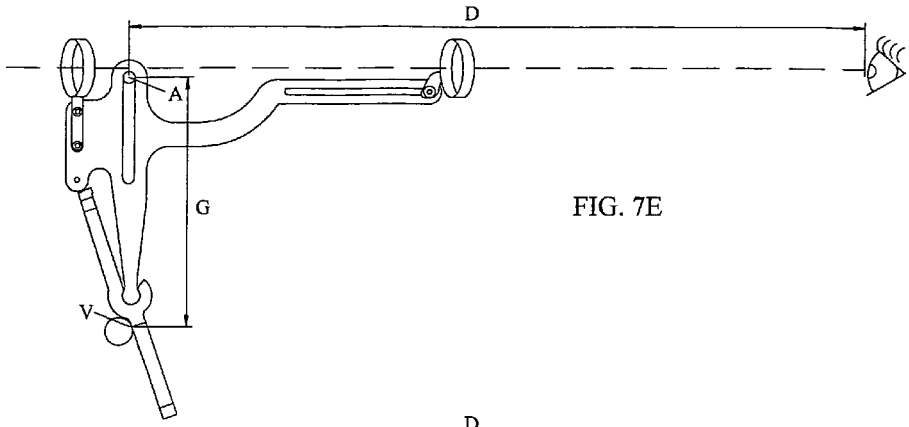
FIGS. 7E, 7F, and 7G illustrate the geometry of the rotation of the sight carrier thereof as the range setting is changed.

The primary advantage of this sight is that it constantly aligns the two sight points with the archer's eye from a stationary anchor point. An explanation of this constant alignment is as follows. Referring first to FIG. 7E, the sight carrier is shown in the lowest position. It shows front and rear sights which define a line of sight from the archer's sight eye labeled "P." The top pivot point in the top of the vertical slot is labeled "A." The contact point between the windlass drum and the strut is labeled "V." The distance from the archer's sight eye to the pivot point A is labeled "D." The distance from the top pivot point A to the contact point V is labeled "G."

Figure 7F:
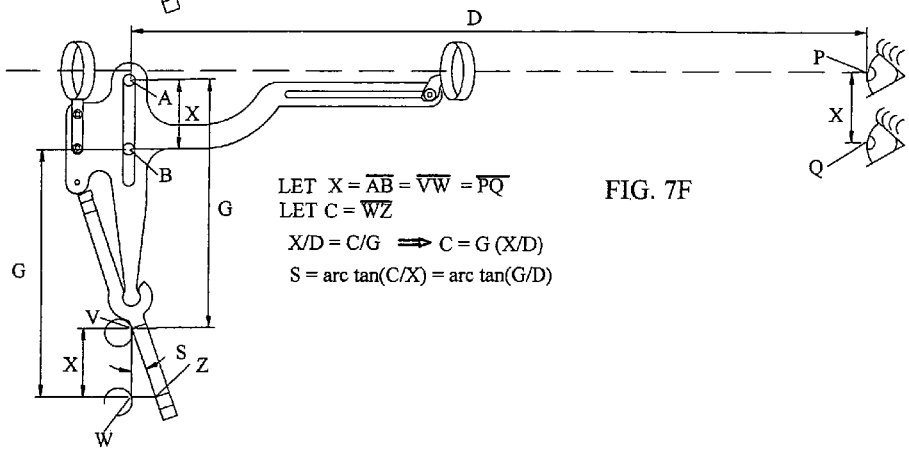

Referring now to FIG. 7F, the sight carrier is elevated a distance "X." The new position of the top pivot point is labeled "B" and the new position of the contact point between the windlass drum and the strut is labeled "W." The new position of the top pivot point B is located a distance X below the original point A. The new contact point is located the same distance X below original point V. The distance from B to W (BW) remains G because both points are fixed to the sight base. The archer's anchor point is determined by the bow, not by the sight carrier position. Therefore, the archer's new sight eye position labeled "Q" is also a distance X lower relative to the sight carrier.

Figure 7G:
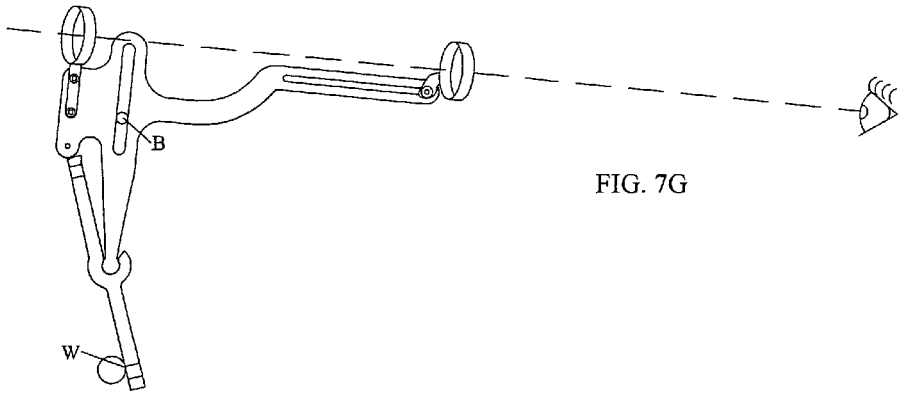

Referring now to FIG. 7G, the sight carrier rotates about the top pivot point B as the carrier is raised a distance X. From simple geometry, it is known that the movement of points on a rotating object vary directly with their distance from the pivot point. Thus, it is known that X/D=C/G and then C=G (X/D). It is also known that VW is vertical so a strut angle labeled "S" is formed. It can be seen that in triangle VWZ, tan (S)=C/X so it follows that S=arc tan(C/X). Substituting C=G (X/D) gives the formula S=arc tan(G/D).

Thus, the strut angle S is determined by the distance G between the two pivot points on the base with the archer's sight eye position D at the anchor point. It is independent of the sight elevation X. Therefore, once the strut angle is adjusted for the draw length of a particular archer, the angle is set for all elevations of the sight carrier. The sight carrier rotates in an arc centered at the archer's sight eye. FIG. 7G shows the position of the sight carrier when it is actually raised the distance X.

4. Calibration

After the archery bow sight is installed and adjusted for draw length, it is calibrated. Calibration is a well known procedure that is essential for all sights. The conventional method of calibrating an archery bow sight is to shoot arrows at targets of known distances while noting the position of the sight that corresponds with the distances.

Figure 7H:
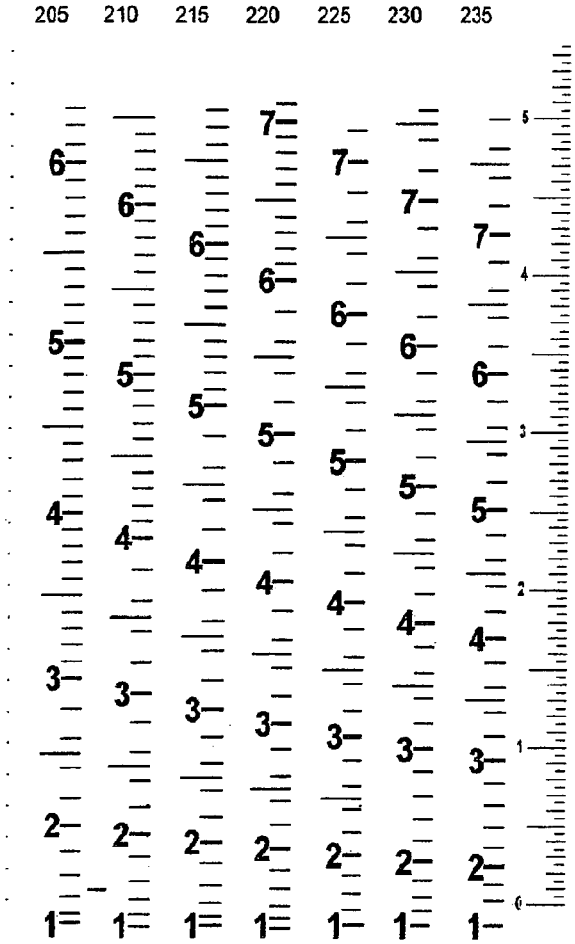
FIG. 7H is a printout generated by the individualized computer generated range scale program.
Figure 7I:
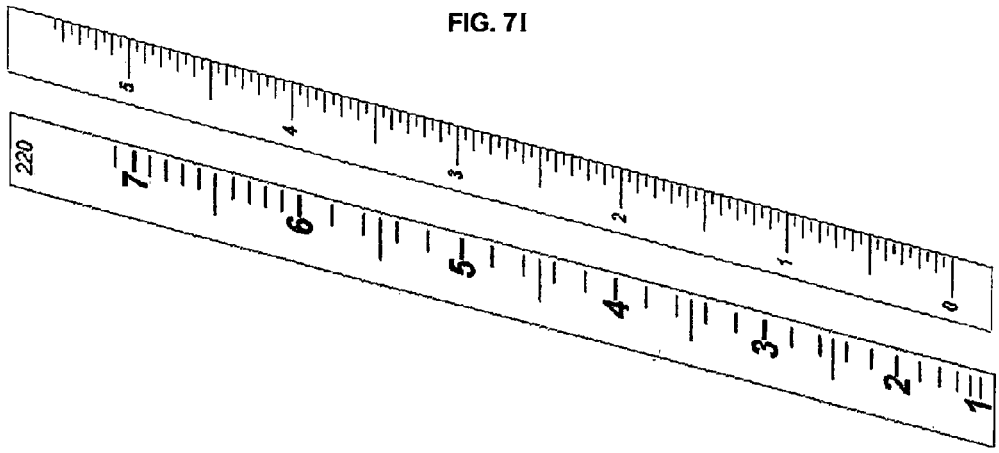
FIG. 7I is an example of an outer surface for the windlass having markings that indicate varying target distances.

A second calibration procedure is also suitable. The second procedure makes use of a range scale that is generated by a computer program, such as Microsoft Visual Studio 2005. Individual input data used in the program include arrow velocity, arrow mass, distance from the archer's eye to the first pivot point, and height of the eye above the arrow. A single air drag factor is used to cover all the factors contributing to air drag such as arrow length, arrow tip, fletching, etc. The mechanical advantage of the range scale is also required input. A scale chart is printed on a four-by-six inch label as shown in FIG. 7H. This label can be cut along the vertical dots to form seven different range scales with different arrow velocities. The eighth scale is a measuring tape to be used to gain additional information to adjust the air drag factor input for a more accurate range scale. FIG. 7I shows a single scale and the measuring tape cut from a label.

With the correct individualized computer generated range scale on the range drum, this sight can now be calibrated with the following steps. Using the finger dial, move the sight carrier to the highest position and lock it in that position. Loosen the screw on the clamping hub. Rotate the range drum so the pointer aligns with the lower end of the range scale. That would be on the eleven yard mark on the range scales shown in FIG. 7I. Clamp the range drum in position with the clamping hub. Sight in the front sight point at any selected yardage using only the adjustments on the front sight assembly, keeping the front sight carrier in the highest position. The rear sight point is adjusted in the vertical slot of the rear sight bracket to align with the front sight point and the anchor point.

If the sight is not correct for the longer distances on the range scale, a different range scale is needed. The optimal computer generated range scale can be selected as follows. Place the measuring tape scale on the range drum. This tape is included in the four-by-six inch label as shown in FIG. 7I. Using the finger dial, move the sight carrier to the highest position and lock it in that position. This is the position previously sighted in for eleven yards. Loosen the screw on the clamping disc and rotate the range drum so the pointer aligns with zero on the measuring scale. Clamp the range drum in position with the clamping disc. Using the finger dial adjustments, sight in the bow for two other distances. Record the measurements from the tape for each of the distances. Use those measurements to select the optimal individual range scale. Remove the measuring tape scale from the range drum and replace it with the range scale that best matches the measurements. With the sight carrier in the highest position, align the lower line of the range scale with the pointer. The sight is now accurate for all distances.

5. Use

Once installation, draw length adjustment, and calibration are completed, the archery bow sight is ready for use. To aim the bow, the distance to the target must be known or estimated. The bow is held in the shooting position with the bowstring pulled to the anchor point. When the precise anchor point position is reached, the front sight point and rear sight point should be aligned. They will not be aligned if the precise anchor point is not reached or if the bow hand is twisting the bow riser. The archer moves the finger dial until the range scale is set on the range of the target. He aligns the rear sight point, the front sight point, and the target and releases the arrow.

The mechanical advantage of the finger dial for moving the carriers can be set by varying the diameters of the finger dial and the windlass drum. This flexibility in not easily available with two other commonly used means used to elevate a sight pin, the use of a lever or the use of a screw.

The diameters of the range drum and the windlass drum can be set to give any desired mechanical advantage for the range scale. The mechanical advantage will determine the range scale elongation and the resulting resolution. With a 30 inch draw, one sixteenth of an inch movement of a sight pin will shift the arrow impact point by about 3 inches at 40 yards. If the range drum is constructed three times the diameter of the windlass drum then the 1/16 inch movement of the sight point would be reflected as 3/16 inch on the range scale.

6. Second Embodiment

Figure 8A:
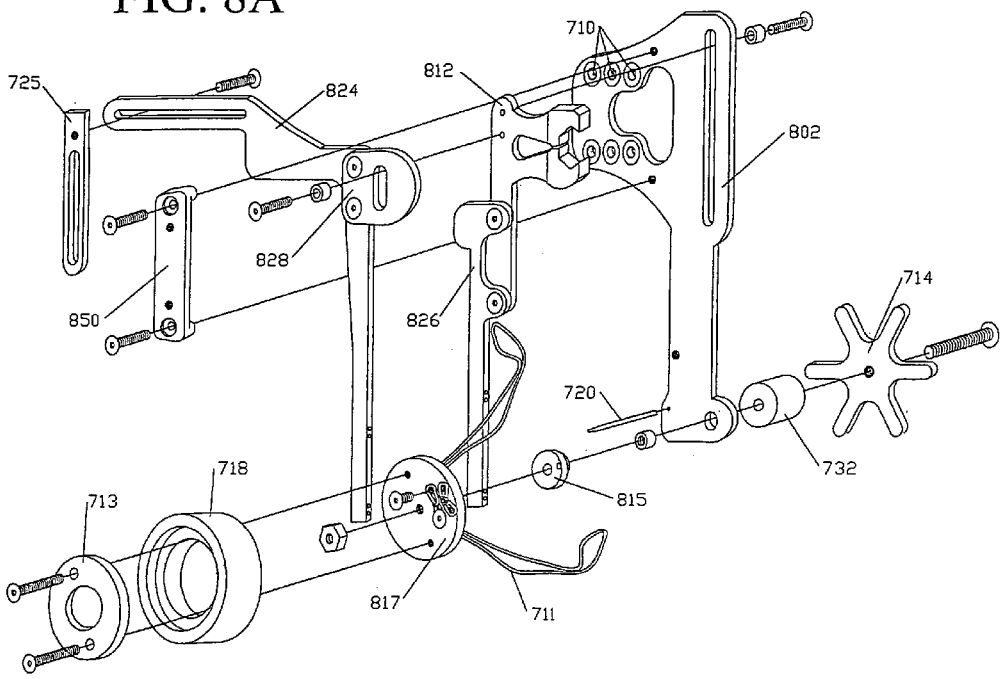
FIG. 8A is an exploded perspective view of a second embodiment of the archery bow sight of this invention.
Figure 8B:
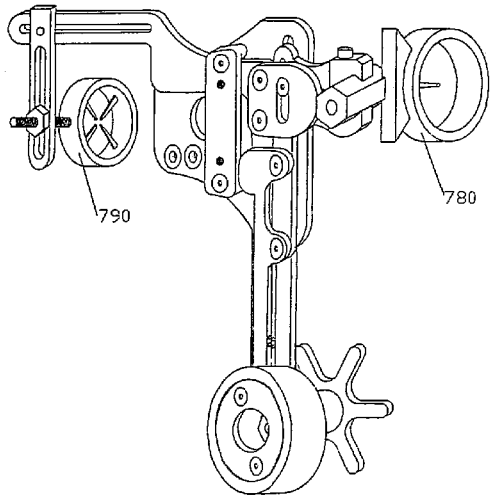
FIG. 8B is an assembled perspective view thereof.

A second embodiment is shown in FIGS. 8A and 8B. This embodiment is known as the "step windlass" embodiment. Like the first embodiment, it perfectly aligns a front sight point and a rear sight point regardless of target distance after adjustment for draw length.

The second embodiment uses a sight base 802 with a vertical slot to guide the movement of the sight carriers. The sight base is mounted to the bow just above the handle. The front sight carrier 812 is mounted on the sight base with a single bushing and screw through the slot in the base. The leg 826 is attached to the front carrier to extend down to operate against the larger step on windlass step drum 815. Thus, the front sight carrier is restricted to only vertical movement. The guide 828 is attached to the front of the rear sight carrier 824 and the rear sight carrier is slid in under the leg. A screw with a bushing through the vertical slot in the guide and screwed into a hole in the front sight carrier holds the two sight carriers together. The downward leg on the rear sight carrier will operate against the smaller drum on the step windlass drum. Thus the rear carrier is also restricted to only vertical movement and the ratio of the movements of the two sight carriers is equal to the ratio of the two drums on the step windlass drum. As with the bridge with the preferred embodiment, the bridge 850 is used to hold the carriers against the base, and a cable is threaded through each of the legs and wrapped around the windlass drums and secured. Likewise, all the other parts are installed as on the preferred embodiment.

The second embodiment is adjusted for draw length as follows. In this embodiment, the ratio of the vertical movement of the rear sight to the front sight is fixed. Referring back to FIG. 6 and the formula, BD/CE is fixed. Therefore, it is necessary to adjust AB/AC. This ratio is adjusted by moving the rear sight along the track in the rear sight carrier, either rearward or forward, until both sights remain in line regardless of target distance.

The operation of the second embodiment of the sight is basically the same as the preferred embodiment but with some restrictions. This sight will not accurately control a scope or a laser and the positions for the front and rear sight points is limited. For example, if the sight ratio is 0.75 and the eye length to the front sight point is 28 inches, then eye length to the rear sight point must be set at 21 inches and the rear sight point is placed 7 inches behind the front sight point.

7. Other Embodiments

Figure 9A:
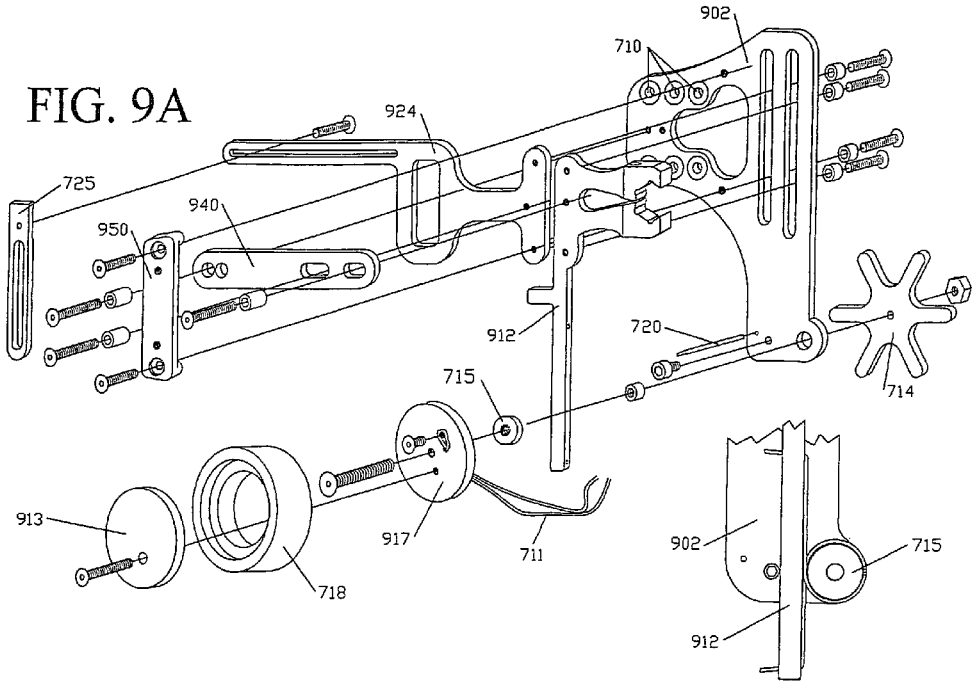
FIG. 9A is an exploded perspective view of a third embodiment of the archery bow sight of this invention.
Figure 9B:
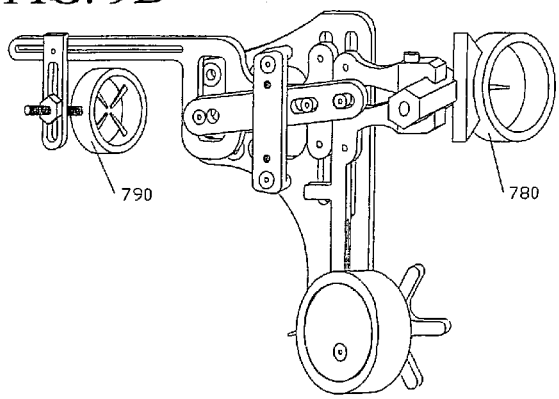
FIG. 9B is an assembled perspective view thereof.

There are several other embodiments of the sight with different means for transmitting the motion of the front sight carrier to the rear sight carrier and with alternatives for the windlass elevation adjustment means. A third embodiment, known as the "one lever" embodiment, is shown in FIGS. 9A and 9B. In this embodiment, a single lever is used for transmitting the motion of the front sight carrier to the rear sight carrier. Operation of the "one lever" embodiment is the same as the "step windlass" embodiment. The ratio of the sight is simply the ratio of the distances from the from the pivot bushing attached to the base to each of the pivot bushings attached to the rear and front sight carriers.

Figure 10A:
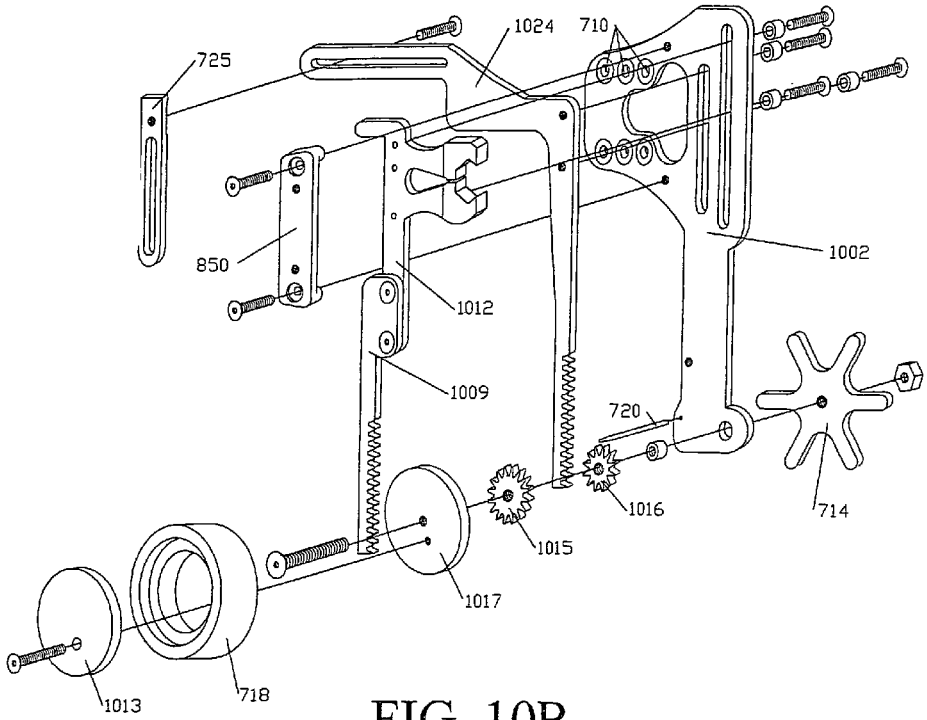
FIG. 10A is an exploded perspective view of a fourth embodiment of the archery bow sight of this invention.
Figure 10B:
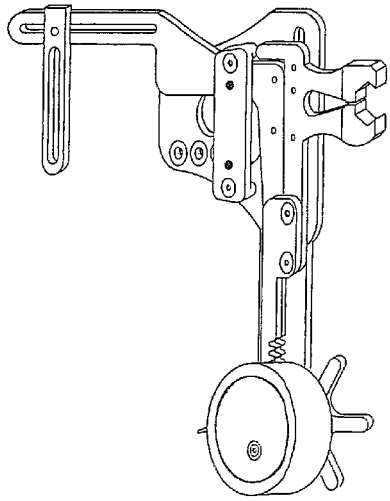
FIG. 10B is an assembled perspective view thereof.

A fourth embodiment, known as the "step gear" embodiment, is shown in FIGS. 10A and 10B. The "step windlass" embodiment was changed to a "step gear" embodiment by replacing the cables with racks on the sight carriers and replacing the windlass drums with a step gear. The ratio of the movement of the rear sight carrier to the front sight carrier will match the ratio of the step gear. The rear sight point and front sight point distances to the archer's eye must be adjusted so that their ratio matches the sight ratio.

Fifth, sixth, and seventh embodiments for the means for transferring the motion of the front sight carrier to the rear sight carrier are shown in FIGS. 11, 12, and 13. The assembling and calibration of these alternatives is similar to the other embodiments and once installation and calibration is completed, their operation is the same as the other options.

Figure 11A:
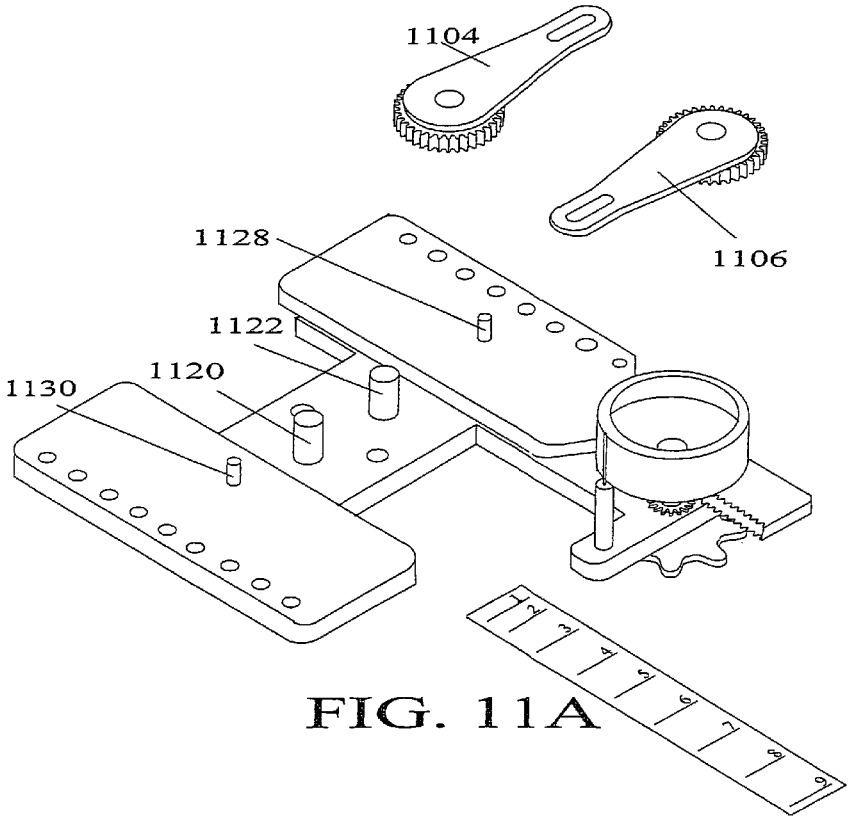
FIG. 11A is an exploded perspective view of the linkage of a fifth embodiment of the archery bow sight of this invention.
Figure 11B:
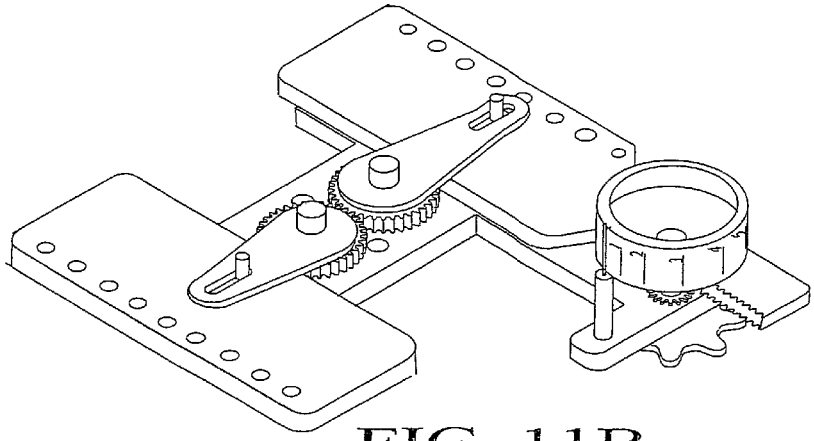
FIG. 11B is an assembled perspective view thereof.

With the "gear-lever" embodiment, FIGS. 11A and 11B, a front pivot 1122 and a rear pivot 1120 are attached to the sight base. Pins 1128 and 1130 are secured to the front and rear sight carrier. The gears are pivoted on pins 1120 and 1122 with the levers engaging pins 1130 and 1128. The ratio of this sight can be changed by moving pins 1128 and 1130 or by changing the diameters of the gears on parts 1104 and 1106. The assembled means in shown in 11B.

Figure 12A:
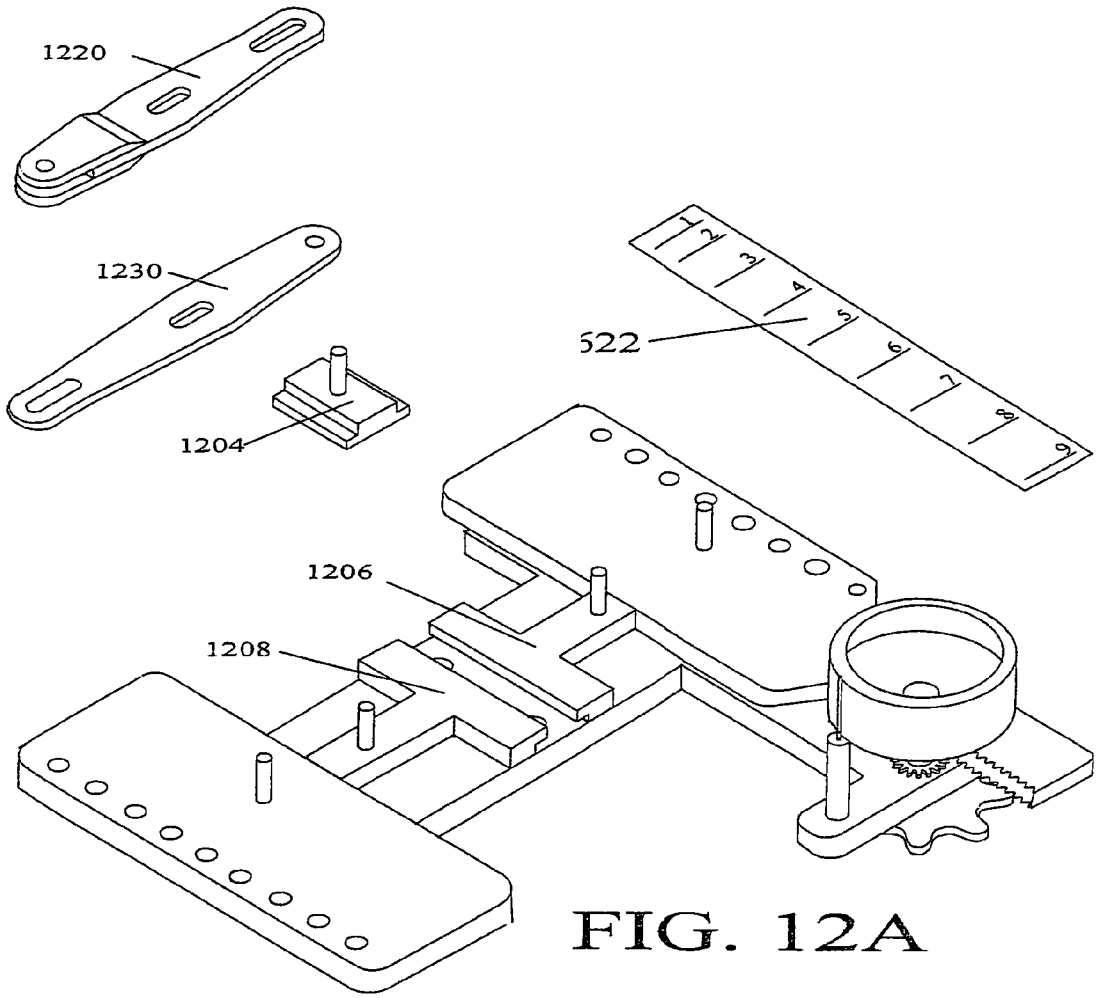
FIG. 12A is an exploded perspective view of the linkage of a sixth embodiment of the archery bow sight of this invention.
Figure 12B:
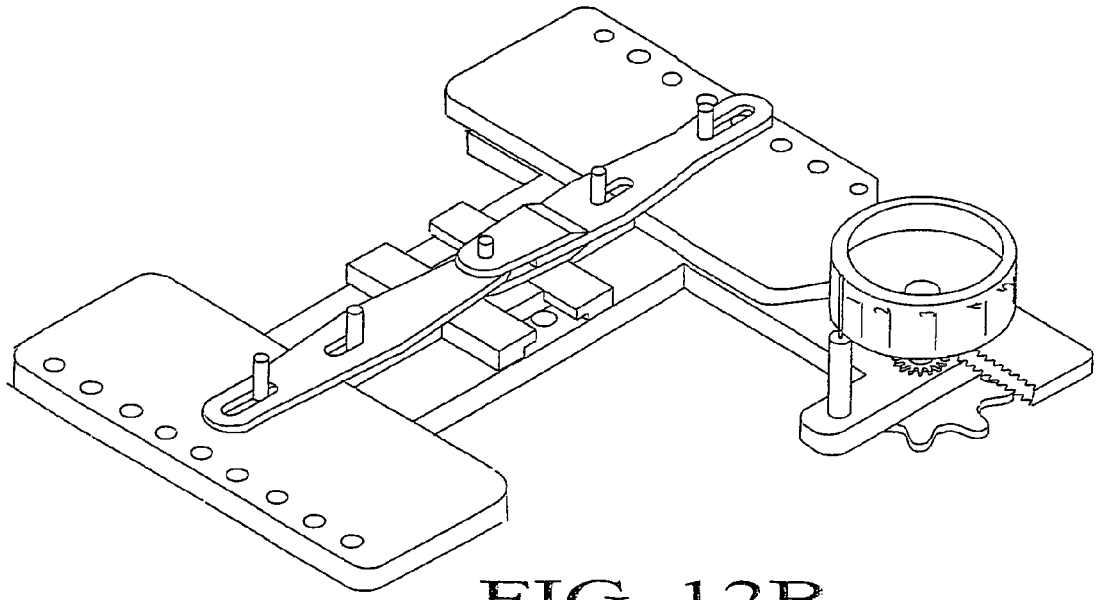
FIG. 12B is an assembled perspective view thereof.

With the "two lever" embodiment, FIGS. 12A and 12B, a front pivot guide 1206 and a rear pivot guide 1208 are attached to the sight base. Pivot pins are attached to the rear sight carrier, the front sight carrier, the sliding pivot, and guides 1206 and 1208. The sliding pivot 1204 is placed under the lips on the pivot guides and slid into place. The end of lever 1230 is placed in the clevis on the end of lever 1220 and the two levers are placed and secured on the five pivots. This assembly will give a constant ratio for the movement of the sight carriers and that ratio can be changed by moving the pivot pins in the two carriers. The assembled means is shown in FIG. 12B.

Figure 13A:
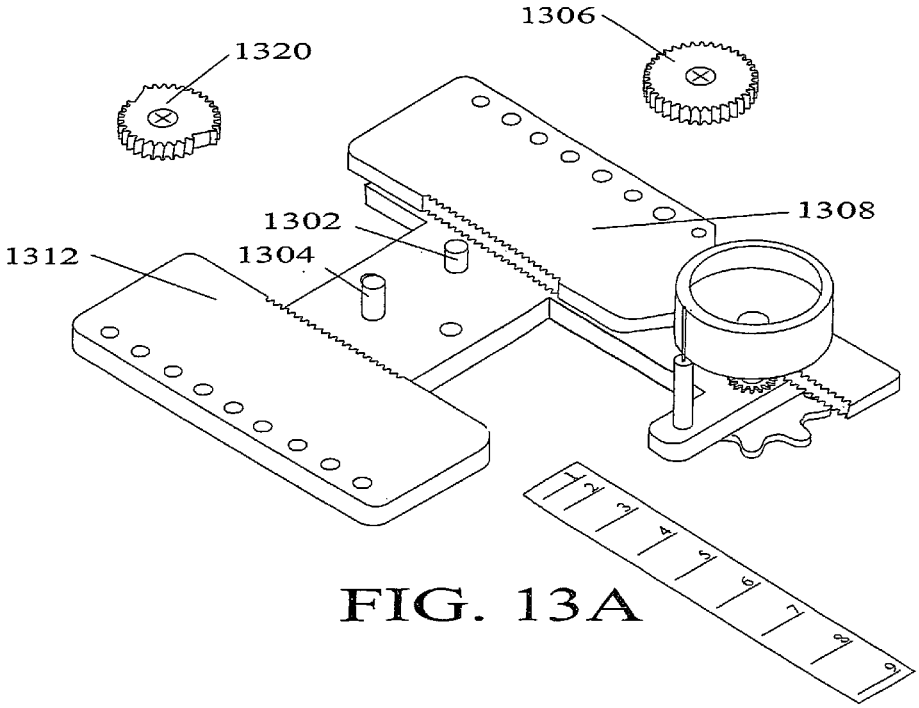
FIG. 13A is an exploded perspective view of the linkage of a seventh embodiment of the archery bow sight of this invention.
Figure 13B:
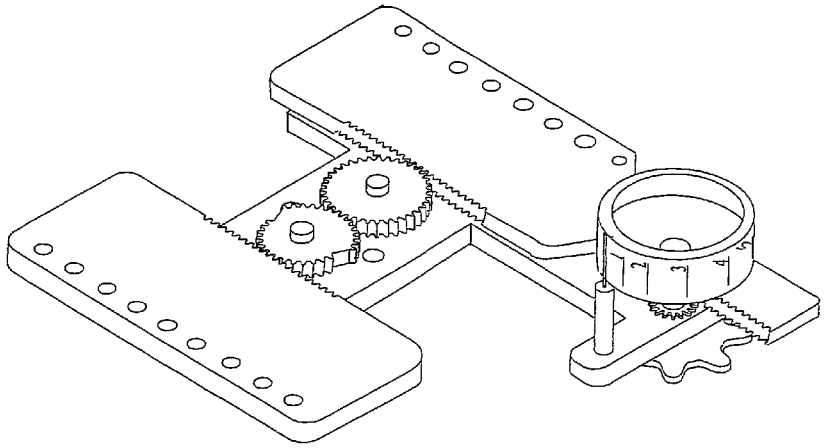
FIG. 13B is an assembled perspective view thereof.

With the "two gear" option, FIGS. 13A and 13B, two pivot pins 1302 and 1304 are attached to the sight base. A rack is attached to the back edge of the front sight carrier 1308. Gear 1306 is pivoted and secured on pin 1302 with its teeth engaging the rack on the front sight carrier. Split gear 1320 is constructed with half the gear having a larger radius. The split gear is pivoted and secured on pin 1304 such that the larger radius of the split gear engages gear 1306. The smaller radius of the split gear engages a rack on the front of the rear sight carrier 1312. The ratio for this sight is equal to the ratio of the two radii on the split gear. The assembled means in shown in 13B.

There are numerous other motion transmission means that can be used to convey the motion from the front sight carrier to the rear sight carrier.

8. The Windlass Mechanism in Other Sights

Figure 14A:
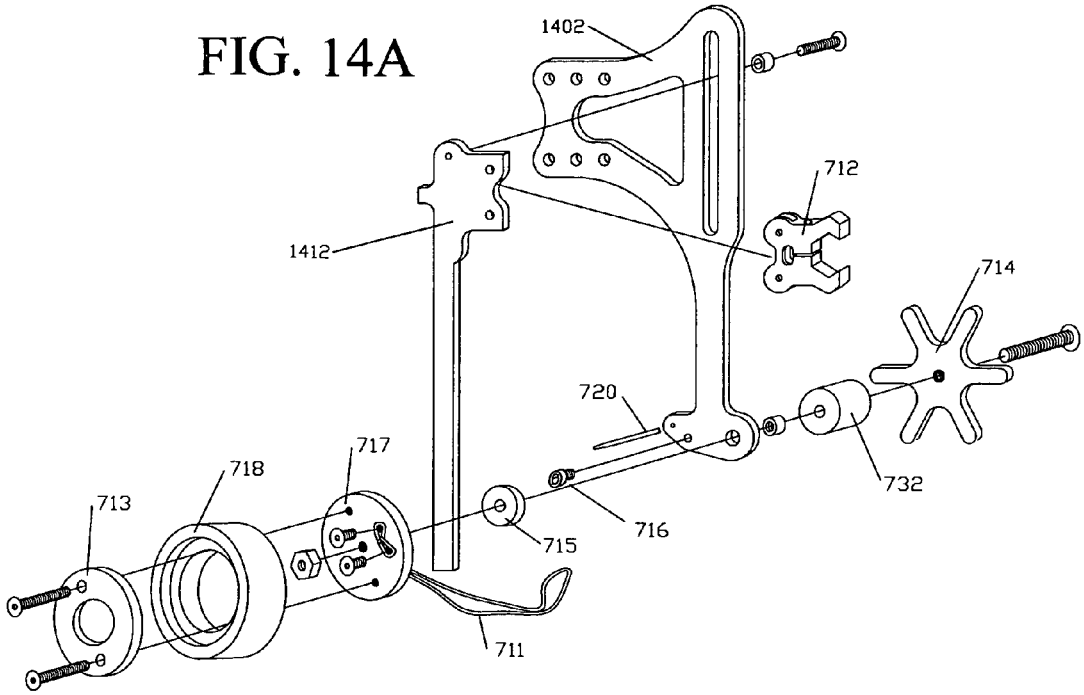
FIG. 14A is an exploded perspective view of a conventional archery bow sight with a single movable sight that is moved by a windlass.
Figure 14B:
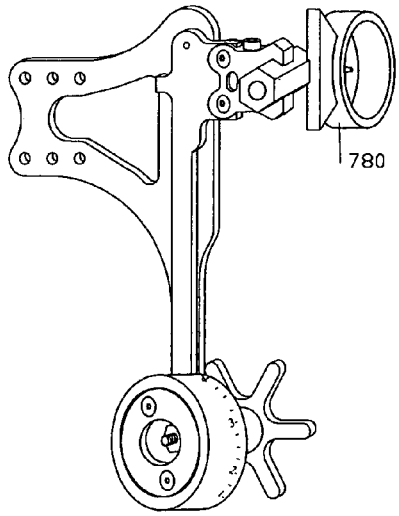
FIG. 14B is an assembled perspective view thereof.

As previously mentioned, the windlass adjustment mechanism is very efficient for adjusting the range settings of the archery bow sight of this invention. For the reasons discussed below, the windlass adjustment mechanism is also useful in adjusting the position of any archery bow sight having a movable front and/or rear sight point. For example, FIGS. 14A and 14B are perspective views of a conventional archery bow sight with a single movable front sight that is moved by a windlass. This sight is used with a peep on the bowstring as previously described.

The friction of the wrapping of cable on the windlass drum is essentially zero. If the windlass drum is positioned such that the cable is against both the drum and the strut arm at the point where it leaves the drum, then 100% of the force on the cable will be transmitted to the arm in the intended direction. No forces in any other direction will be transmitted. Also with a tight cable on the windlass, there is no backlash.

A rack and pinion is common means used to adjust sight points. There is always some backlash. The efficiency of a rack and pinion depends on the angle of contact between the teeth. An angle commonly used for gear teeth is 14.5 degrees. With no friction, this angle would give a maximum efficiency of about 97%. Since the gear teeth are at an angle, they are constantly trying to push out and slide past each other. Even with no friction, this generates a force on the rack perpendicular to its direction of travel. With a contact angle of 14.5 degrees, that force is over one-fourth of the vertical force on the rack. With friction, the drag from the side force increases the vertical force required to move the rack. Using a low coefficient of friction of 0.2 for the side force, the efficiency of a rack and pinion drops to less than 92%. There is also additional friction and drag in the engagement and disengagement of the teeth. The efficiency is farther reduced with limited lubrication and machine quality of the teeth. From the operation of prototypes of each, the windlass is much smoother and the force required to operate the movable points with the windlass is noticeably less than the force required for the rack and pinion.

I claim:

1. An archery bow sight for use by an archer holding a bow with a first hand, fully drawing an arrow mounted in the bow to an anchor point with a second hand to establish a draw length, and aiming with a sight eye, the bow sight comprising:

(a) a frame adapted for mounting onto a bow;

(b) a rear sight attached to the frame, the rear sight being movable vertically and being positioned a first horizontal distance from the archer's sight eye;

(c) a front sight attached to the frame, the front sight being movable vertically, being positioned a second horizontal distance from the archer's sight eye, and being further positioned in a line of sight from the archer's sight eye through the rear sight;

(d) a linkage between the rear sight and the front sight for simultaneously moving the rear sight a first vertical distance and the front sight a second vertical distance to correspond to targets of varying distance; and (e) a means for initially adjusting the sight to conform to a draw length of a particular archer to ensure that the ratio of the first vertical distance divided by the second vertical distance equals the first horizontal distance divided by the second horizontal distance, the means comprising either an adjustment to the linkage to change the ratio of the first vertical distance divided by the second vertical distance or an adjustment to the horizontal position of the rear sight or front sight to change the ratio of the first horizontal distance divided by the second horizontal distance;

such that the rear sight and the front sight remain in a line of sight from the archer's sight eye to targets of varying distance.

2. The archery bow sight of claim 1 wherein the linkage contains a means for movement by the archer's first hand with the bow drawn to an anchor point.

3. The archery bow sight of claim 2 wherein the linkage comprises a windlass.

4. The archery bow sight of claim 3 wherein the windlass contains an outer surface having markings that indicate varying target distances.

5. The archery bow sight of claim 4 wherein a toothed ring is connected to the windlass.

6. The archery bow sight of claim 5 wherein the means for initially adjusting the sight comprises a linkage to change the ratio of the first vertical distance divided by the second vertical distance.

7. The archery bow sight of claim 6 wherein the linkage comprises a means for rotating the rear sight and the front sight in arcs about the sight eye.

8. The archery bow sight of claim 7 wherein the linkage comprises a strut that is vertically movable by rotation of the windlass and a sight carrier engaged by the strut and that is adjustably angled from the strut.

9. The archery bow sight of claim 5 wherein the means for initially adjusting the sight comprises a rear sight that is movable horizontally to change the ratio of the first horizontal distance divided by the second horizontal distance.

10. The archery bow sight of claim 9 wherein the linkage comprises a lever pivoting about a fulcrum away from the archer, the lever being connected to the rear sight at a first point and being connected to the front sight at a second point further from the fulcrum.

11. A method for an archer to aim a bow at a distant target with the bow drawn to an anchor point to establish a draw length and with a sight eye viewing the target, the method comprising:

(a) providing a bow with an attached sight, the sight comprising:

(i) a frame mounted onto the bow;

(ii) a rear sight attached to the frame, the rear sight being movable vertically and being positioned a first horizontal distance from the archer's sight eye;

(iii) a front sight attached to the frame, the front sight being movable vertically, being positioned a second horizontal distance from the archer's sight eye, and being further positioned in a line of sight from the archer's sight eye through the rear sight; and (iv) a linkage between the rear sight and the front sight for simultaneously moving the rear sight a first vertical distance and the front sight a second vertical distance to correspond to targets of varying distance;

(b) initially adjusting the sight to conform to the draw length of the archer to ensure that the ratio of the first vertical distance divided by the second vertical distance equals the first horizontal distance divided by the second horizontal distance, the initial adjustment being performed by either adjusting the linkage to change the ratio of the first vertical distance divided by the second vertical distance or by adjusting the horizontal position of the rear sight or front sight to change the ratio of the first horizontal distance divided by the second horizontal distance; and (c) moving the linkage to correspond to the distance of the target.

12. The method of claim 11 wherein the linkage of the sight comprises a windlass.

13. The method of claim 12 wherein the windlass of the sight contains an outer surface having markings that indicate varying target distances.

14. The method of claim 13 wherein a toothed ring is connected to the windlass of the sight for rotating the windlass.

15. The method of claim 14 wherein the linkage is moved by the hand holding the bow when the bow is drawn to the anchor point.

16. The method of claim 15 wherein the sight is initially adjusted for the archer's draw length by adjusting the linkage to change the ratio of the first vertical distance divided by the second vertical distance.

17. The method of claim 15 wherein the sight is initially adjusted for the archer's draw length by moving the rear sight horizontally to change the ratio of the first horizontal distance divided by the second horizontal distance.

* * * * *